US005294779A

United States Patent [19]

Miquelot

[11] Patent Number: 5,294,779

[45] Date of Patent: Mar. 15, 1994

[54] ELECTRIC HOTPLATE WITH RECEPTACLE PRESENCE DETECTING AND TEMPERATURE MEASURING MEANS

[75] Inventor: Gilles Miquelot, Rumilly, France

[73] Assignee: SEB S.A., Selongey, France

[21] Appl. No.: 997,938

[22] Filed: Dec. 29, 1992

[30] Foreign Application Priority Data

Jan. 8, 1992 [FR] France ..... 92 00126

[51] Int. Cl.[5] ..... F24C 7/08; H05B 1/02; H05B 3/68

[52] U.S. Cl. ..... 219/450; 219/518

[58] Field of Search ..... 219/518, 450, 449

[56] References Cited

U.S. PATENT DOCUMENTS

| | | | |
|---|---|---|---|
| 2,430,196 | 11/1947 | Vaughan | 219/450 |
| 2,898,439 | 8/1959 | Wantz et al. | 219/450 |
| 2,913,562 | 11/1959 | Weber et al. . | |
| 3,018,356 | 1/1962 | Busch et al. | 219/450 |
| 3,042,783 | 7/1962 | Mertler | 219/450 |
| 4,214,150 | 7/1980 | Cunningham | 219/518 |
| 4,241,289 | 12/1980 | Bowling | 219/450 |
| 4,499,368 | 12/1985 | Payne | 219/450 |
| 5,001,328 | 3/1991 | Schreder et al. | 219/449 |

FOREIGN PATENT DOCUMENTS

| | | | |
|---|---|---|---|
| 0203449 | 12/1986 | European Pat. Off. . | |
| 478081 | 9/1991 | European Pat. Off. . | |
| 805538 | 5/1951 | Fed. Rep. of Germany . | |
| 3619762 | 12/1987 | Fed. Rep. of Germany | 219/518 |
| 1339136 | 8/1963 | France | 219/450 |
| 426838 | 11/1947 | Italy | 219/450 |
| 61-176826 | 8/1986 | Japan | 219/450 |
| 690245 | 4/1953 | United Kingdom . | |
| 720356 | 12/1954 | United Kingdom . | |
| 2042171 | 9/1980 | United Kingdom . | |
| 2064894 | 6/1981 | United Kingdom . | |
| 1594385 | 7/1981 | United Kingdom . | |

*Primary Examiner*—Bruce A. Reynolds
*Assistant Examiner*—John A. Jeffrey
*Attorney, Agent, or Firm*—Young & Thompson

[57] ABSTRACT

Electric hotplate (1) comprising a temperature sensor (3) which includes a temperature-sensitive surface (4) projecting with respect to the surface of the hotplate intended to receive a cooking receptacle. The sensor (3) comprises in combination a device (5) for measuring the temperature of the temperature-sensitive surface (4); a detector (7, 8) for detecting the presence of the receptacle on said hotplate; and a fuse (6, 23) comprising a thermal safety element in contact with the temperature-sensitive surface (4) for cutting off the electrical supply to the hotplate (1) when the temperature reaches a predetermined maximum value.

9 Claims, 2 Drawing Sheets

ELECTRIC HOTPLATE WITH RECEPTACLE PRESENCE DETECTING AND TEMPERATURE MEASURING MEANS

FIELD OF THE INVENTION

The present invention relates to an electric hotplate comprising a temperature sensor which includes a temperature-sensitive surface projecting with respect to the surface of the cooking plate intended to receive a cooking receptacle.

PRIOR ART

This hotplate is intended in particular to heat a cooking receptacle such as described in patent applications U.S. Pat. Nos. 8,808,379 and 8,808,380 of Jun. 22, 1988 in the name of the assignee.

The heating base described in these two patent applications includes a recess in which is housed the lower part of the cooking receptacle. This heating base includes a temperature sensor which comes into contact with the wall of the cooking receptacle.

This temperature sensor measures the temperature of the wall of the receptacle, which makes it possible to follow the temperature-rise curve. A microprocessor associated with the temperature sensor turns off the heating when a certain temperature is reached, then provides regulation of the temperature.

SUMMARY OF THE INVENTION

The aim of the present invention is to create a hotplate able to receive any receptacle, this hotplate including a temperature sensor making it possible to carry out functions other than measuring the temperature of the wall of the cooking receptacle.

Hence the invention envisages an electric hotplate comprising a temperature sensor which includes a temperature-sensitive surface projecting with respect to the surface of the hotplate intended to receive a cooking receptacle.

According to the invention,, this hotplate is distinguished in that said sensor comprises in combination:

means for measuring the temperature of said temperature-sensitive surface;

means for detecting the presence of the receptacle on said hotplate; and means forming a fuse for cutting off the electrical supply to the hotplate when the temperature reaches a predetermined maximum value.

Hence the sensor carries out three different functions.

Moreover, the hotplate can receive cooking receptacles of different dimensions.

According to a preferred version of the invention, said means for measuring the temperature comprise a temperature probe in thermal contact with that surface of the sensor which is intended to come into contact with the cooking receptacle.

According to another preferred version of the invention, said means for detecting the presence of the receptacle comprise two electrical contacts linked to the terminals of the temperature probe, one of these contacts being fixed with respect to the hotplate and the other being integral with the sensor, these two contacts being in contact with each other in the absence of the cooking receptacle so as to shortcircuit the temperature probe, said sensor being able to move under the effect of the weight of the cooking receptacle in order to separate the two contacts and bring about heating of the hotplate.

According to another feature of the invention, the sensor includes a thermal safety element equipped with a fuse element which, under the effect of a prescribed maximum temperature, melts and opens an electrical contact thus definitely putting a stop to the heating. This safety element is in contact with the capsule.

BRIEF DESCRIPTION OF THE DRAWINGS

In the attached drawings given by way of non-limiting examples.

DESCRIPTION OF THE PREFERRED EMBODIMENTS

Figure 1:
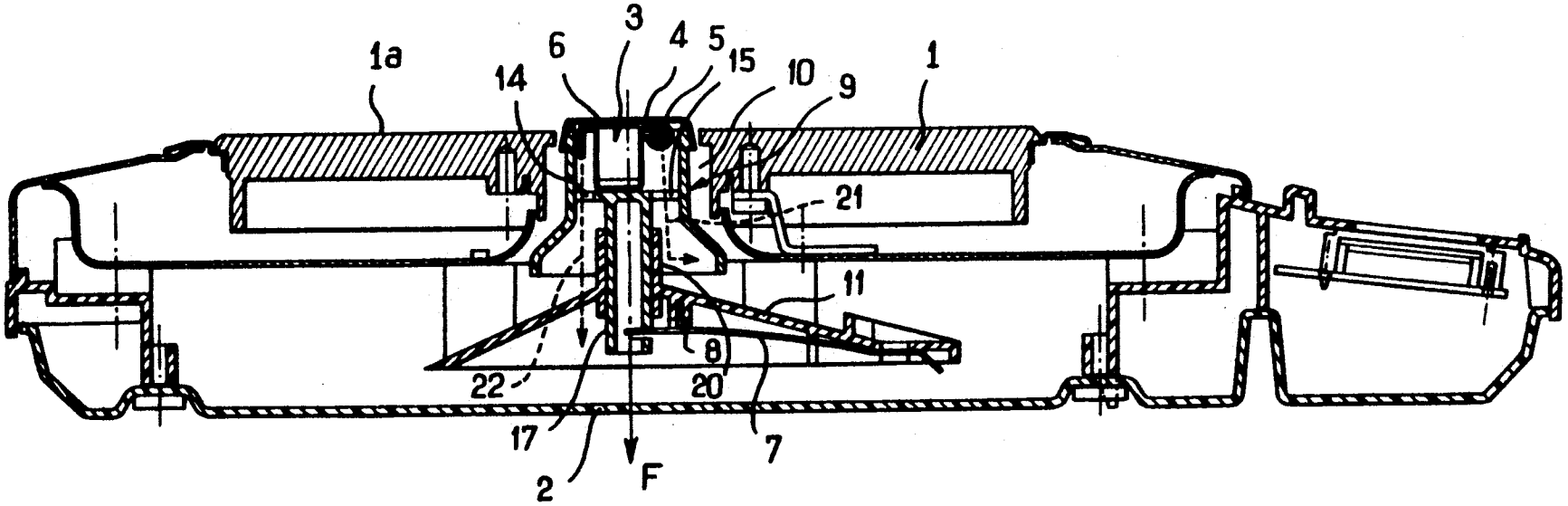
FIG. 1 is a sectional view of a hotplate in accordance with the invention.

In the embodiment of FIG. 1,, the electric hotplate 1 carried by a base 2 comprises a temperature sensor 3 which includes a temperature-sensitive surface 4 projecting with respect to the upper surface 1*a* of the hotplate 1 intended to receive a cooking receptacle.

In accordance with the invention, the sensor 3 comprises in combination means for measuring the temperature of the temperature-sensitive surface 4;

means for detecting the presence of a receptacle on said hotplate 1; and means forming a fuse for definitively cutting off the electrical supply to the hotplate when the temperature reaches a predetermined maximum value.

The means for measuring the temperature comprise a temperature probe 5 (made, for example, from platinum, nickel or silicon), in thermal contact with that surface 4 of the sensor 3 which is intended to come into contact with the cooking receptacle. This temperature probe 5 is crimped to the side of a metal plate 6 in contact with a metal capsule 4 comprising said sensitive surface of the sensor 3.

The means for detecting the presence of the receptacle comprise two electrical contacts 7, 8 linked to the terminals of the temperature probe 5. One 7 of these contacts is fixed with respect to the hotplate 1 and the other contact 8 is integral with the sensor 3. These two contacts 7, 8 are in contact with each other in the absence of the cooking receptacle, as represented in FIG. 1, so as to short-circuit the temperature probe 5.

The sensor 3 can move in the direction of the arrow F under the effect of the weight of a cooking receptacle, in order to separate the two contacts 7, 8 and bring about heating and regulation of the temperature of the hotplate 3.

In the example represented (see also FIG. 2), the sensor 3 is housed in a sensor body 9 made in an electrically insulating material such as a plastic material which is mounted so as to slide in a central recess 10 of the hotplate 1 counter to the action of a conducting elastic blade 7 constituting said contact integral with the sensor. The other electrical contact 8 is fixed to a part 11 of the base 2 of the hotplate in which the body 9 of the sensor is mounted so as to slide.

More precisely, the body 9 of the sensor comprises an outer skirt 12 which is open at each end and comprises within it a transverse partition 13 having apertures 14, 15. This partition 13 on the one hand defines with the skirt 12 a housing 16 for the sensor 3 and on the other hand carries a stem 17 which is mounted so as to slide in a sleeve 20 which is fixed with respect to the base 2. This stem 17 comprises a lateral aperture 19 in which the end of the conducting elastic blade 7 is engaged.

The end of the skirt 12 adjacent to the housing 16 of the sensor 3 is closed by the metal capsule 4 bearing on the plate 6. This capsule 4 is crimped to the edge of the skirt 12 and a joint is contained between this capsule 4 and the edge of the skirt.

The apertures 14, 15 of the transverse partition 13 of the sensor body 9 define passages for the conducting wires 21, 22 linked to the temperature probe 5, to the plate 6 of the sensor and other parts of the sensor as well as the connection wires to the electrical contacts of the thermal safety device.

Moreover, the plate 6 of the sensor 3, made in aluminium alloy, which already serves for fixing to the probe 5, is crimped to the body of the thermal safety device 23.

This plate 6 is put in contact with the capsule 4 by means of the elastic support 24 forming a spring.

In order to improve the thermal contact between the plate 6 and the capsule 4, a film of thermal lubricant is put in place.

The body of the thermal safety device 23 contains a fuse element in contact with the plate 6, which, under the effect of a predetermined maximum temperature, melts and allows an electrical contact to open freely, thus definitively cutting off the electrical supply to the plate. The fuse element and the contact are not represented in the drawings, they take the form of a commercially standard electromechanical component element, such as possibly a thermostat.

The sensor which has just been described operates in the following way:

When a cooking receptacle rests on the hotplate 1, the sensor 3 is in elastic contact with the receptacle via its capsule 4. The elasticity of the contact is defined by the elastic contact blade 7. The temperature of the wall of the receptacle is continuously measured by the temperature probe 5 which sends the measured value to a microprocessor (not shown). Regulation of the temperature is carried out as described in French patent applications 8 808 319 and 8 808 380 of the assignee.

Figure 2:
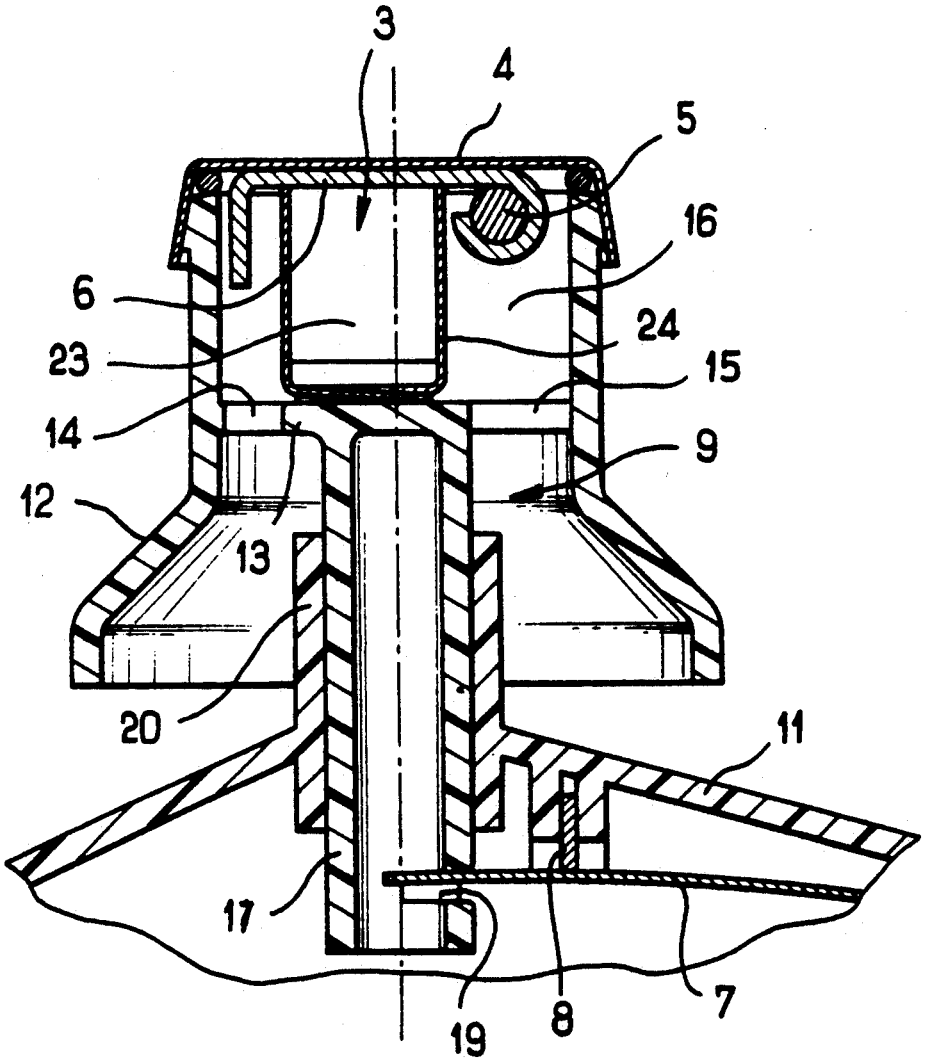
FIG. 2 is a sectional view on an enlarged scale of the sensor of the hotplate.

Detection of the presence of the cooking receptacle on the hotplate 1 is carried out by the contacts 7 and 8. In the absence of a receptacle, the two contacts 7 and 8 bear on each other as indicated in FIGS. 1 and 2, and shortcircuit the temperature probe 5.

The microprocessor linked to the probe 5 detects a zero temperature and deduces therefrom that there is no receptacle.

In the presence of a receptacle, the sensor 3 moves downwards, and the contacts 7 and 8 move apart. The temperature measured by the probe 5 is other than zero. The microprocessor deduces therefrom the presence of the receptacle and then turns on the heating and regulation.

The thermal fuse integrated into the sensor protects the appliance, in the event of a malfunction in the control electronics. When this fuse melts, the electrical power supply is automatically cut off.

Needless to say, the invention is not limited to the embodiment which has just been described and numerous modifications may be made to it without departing from the scope of the invention.

I claim:

1. Electric hotplate (1) comprising a temperature sensor (3) which includes a temperature-sensitive surface (4) projecting with respect to the surface of the hotplate intended to receive a cooking receptacle, wherein said sensor (3) comprises in combination:

means (5) for measuring the temperature of said temperature-sensitive surface (4);

means (7, 8) for detecting the presence of the receptacle on said hotplate; and means (6, 23) forming a fuse comprising a thermal safety element in contact with said temperature-sensitive surface (4) for cutting off the electrical supply to the hotplate (1) when the temperature reaches a predetermined maximum value.

2. The hotplate as claimed in claim 1, wherein said means for measuring the temperature comprise a temperature probe (5) in thermal contact with that surface (4) of the sensor which is intended to come into contact with the cooking receptacle.

3. The hotplate as claimed in claim 2, wherein said temperature probe (5) is clamped to the side of a metal plate (6) in contact with a metal capsule (4) comprising said surface of the sensor.

4. The hotplate as claimed in claim 2, wherein said means for detecting the presence of the receptacle comprise two electrical contacts (7, 8) linked to the terminals of the temperature probe (5), one (7) of these contacts being fixed with respect to the hotplate and the other (8) being integral with the sensor (3), these two contacts being in contact with each other in the absence of the cooking receptacle so as to short-circuit the temperature probe (5), said sensor (3) being able to move under the effect of the weight of the cooking receptacle in order to separate the two contacts (7, 8) and bring about heating of the hotplate.

5. The hotplate as claimed in claim 4, wherein the sensor (3) is housed in a sensor body (9) made in an electrically insulating material which is mounted so as to slide in a central recess (10) of the hotplate (1) counter to the action of the conducting elastic blade (7) constituting said contact integral with the sensor, the other contact (8) being fixed to a part (11) of the base (2) of the hotplate (1) in which the body (9) of the sensor is mounted so as to slide.

6. The hotplate as claimed in claim 5, wherein the body (9) of the sensor comprises an outer skirt (12) which is open at each end and comprises within it a transverse partition (13) having apertures (14, 15) this partition (13) on the one hand defining with the skirt (12) a housing (16) for the sensor (3) and on the other hand carrying a stem (17) which is mounted so as to slide in a sleeve (20) which is fixed with respect to the base (2), this stem (17) comprising a lateral aperture (19) in which the end of said conducting elastic blade (7) is engaged.

7. The hotplate as claimed in claim 6, wherein the end of the skirt (12) adjacent to the housing (16) of the sensor (3) is closed by a metal capsule (4) bearing on the plate of the sensor (6).

8. The hotplate as claimed in claim 6, wherein the apertures (14, 15) of the transverse partition (13) of the sensor body define passages for the conducting wires (21, 22) linked to the temperature probe (5), to the plate (6) of the sensor and other parts of the sensor and the electrical contacts of the thermal fuse.

9. The hotplate as claimed in claim 1, wherein the thermal safety element is equipped with a fuse element (23) which, under the effect of a prescribed maximum temperature, melts and opens an electrical contact thus definitively putting a stop to the heating.

* * * * *